US006676039B2

(12) United States Patent
Lindsey et al.

(10) Patent No.: US 6,676,039 B2
(45) Date of Patent: Jan. 13, 2004

(54) PRESSURIZED ABRASIVE FEED AND METERING SYSTEM FOR WATERJET CUTTING SYSTEMS

(75) Inventors: Orville L. Lindsey, Lynchburg, VA (US); Michael C. Gould, Lynchburg, VA (US)

(73) Assignee: Framatome ANP, Inc., Lynchburg, VA (US)

( * ) Notice: Subject to any disclaimer, the term of this patent is extended or adjusted under 35 U.S.C. 154(b) by 0 days.

(21) Appl. No.: 09/757,190

(22) Filed: Jan. 9, 2001

(65) Prior Publication Data

US 2001/0030245 A1 Oct. 18, 2001

Related U.S. Application Data

(60) Provisional application No. 60/180,623, filed on Feb. 7, 2000.

(51) Int. Cl.[7] ..... B05B 7/14; A62C 11/00; A62C 5/02; A62C 5/00

(52) U.S. Cl. ..... 239/325; 239/329; 239/310; 239/311

(58) Field of Search ..... 239/310, 311, 239/325, 329, 336, 373, 586, 587, 589

(56) References Cited

U.S. PATENT DOCUMENTS

| | | | | | |
|---|---|---|---|---|---|
| 4,250,908 | A | * | 2/1981 | Velie | 137/7 |
| 4,512,515 | A | * | 4/1985 | Tenney | 239/129 |
| 4,534,427 | A | * | 8/1985 | Wang et al. | 175/67 |
| 4,594,924 | A | * | 6/1986 | Windisch | 83/177 |
| 4,821,467 | A | * | 4/1989 | Woodson et al. | 51/436 |
| 5,133,500 | A | * | 7/1992 | Simpson | 239/150 |
| 5,150,690 | A | * | 9/1992 | Carter et al. | 123/527 |
| 5,213,263 | A | * | 5/1993 | Corona | 239/304 |
| 5,785,127 | A | * | 7/1998 | Miller, Sr. | 169/71 |
| 6,220,529 | B1 | * | 4/2001 | Xu | 239/569 |

* cited by examiner

*Primary Examiner*—Davis Hwu
(74) *Attorney, Agent, or Firm*—Vytas R. Watas

(57) ABSTRACT

The present invention provides an improved abrasive delivery system for delivering an abrasive material to a waterjet cutting nozzle which has no external pressure effects on the orifice metering the flow of abrasive material from a container for the material by using air pressure to transport the abrasive material to the cutting nozzle through a standard metering orifice where equal pressure is maintained above and below the orifice to provide a constant volume of abrasive material flow to the cutting nozzle which is located up to 100 feet or more from the metering device.

1 Claim, 1 Drawing Sheet

: Pressurized Abrasive Delivery System

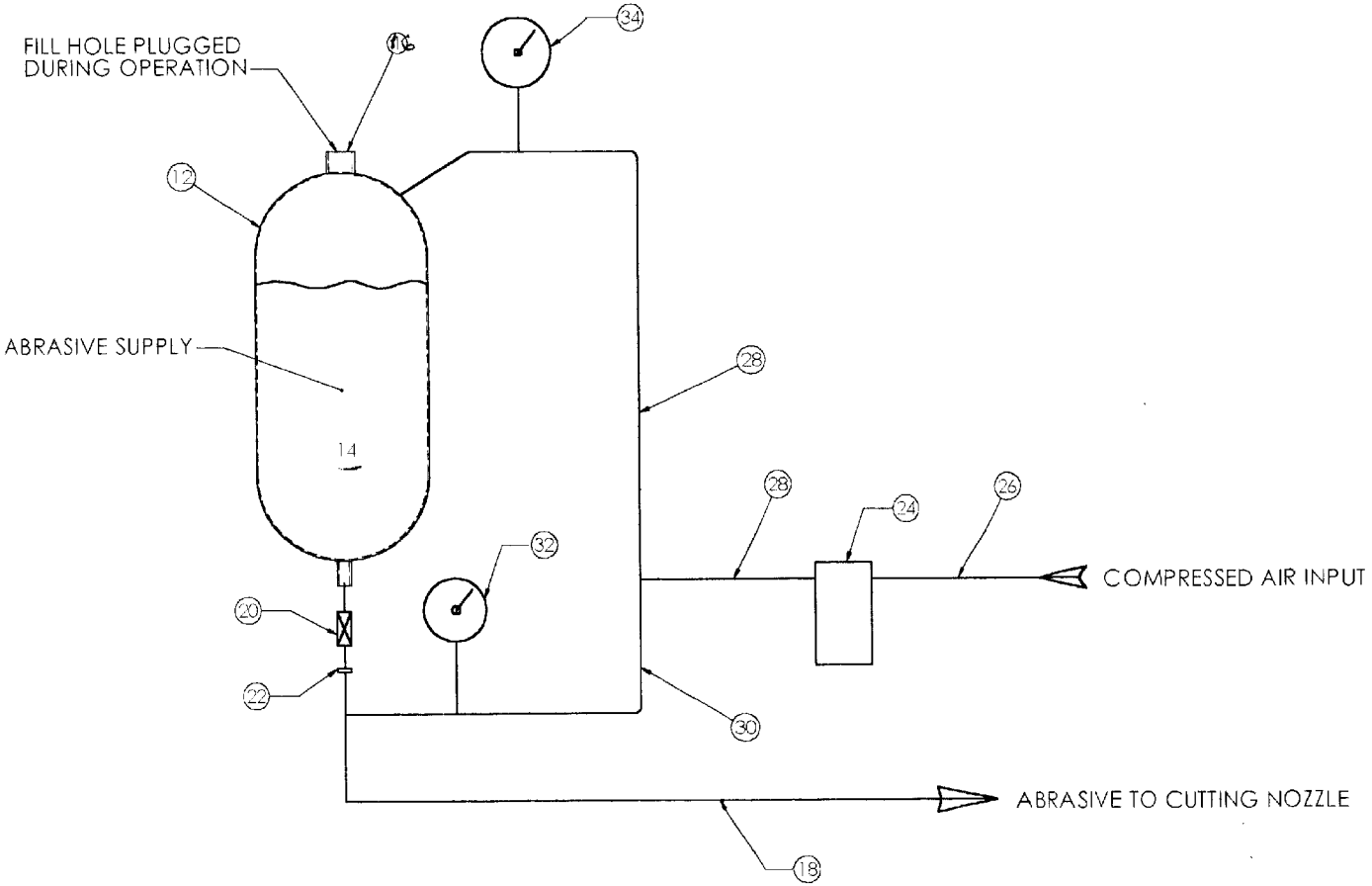
Figure 1 : Pressurized Abrasive Delivery System

PRESSURIZED ABRASIVE FEED AND METERING SYSTEM FOR WATERJET CUTTING SYSTEMS

This application claims the benefit of Provisional Application No. 60/180,623 filed Feb. 7, 2000.

BACKGROUND OF THE INVENTION

1. Field of the Invention

The present invention generally relates to waterjet cutting systems and more particularly to abrasive feed systems for same.

2. Description of the Prior Art

Waterjet cutting is well known and involves the use of pure high pressure waterjets containing abrasive particles being used to cut or peen materials such as stainless steel. Various types of abrasive materials are used including ice crystals. Such systems are known and examples of same are found in various U.S. patents.

One system shown in U.S. Pat. No. 5,778,713 teaches the use of abrasive material waterjet devices underwater for peening and not waterjet cutting.

Another system is shown in U.S. Pat. No. 5,211,752 to Allerton. Which teaches an abrasive material waterjet cutting application other than underwater cutting.

The above described abrasive waterjet (AWJ) processes require that the cutting abrasive be metered to the cutting nozzle at a constant rate. During some applications the abrasive must be delivered to the nozzle from a hopper at great distances such as 100 feet or more. This same abrasive must still be metered to a constant known flow rate. All of the known existing systems, require that the abrasive metering system be located close to the cutting nozzle, usually within 5 feet, and depend on the vacuum created in the nozzle to pull the metered abrasive into the high pressure jet. Other abrasive metering devices are known which use various embodiments for trying to maintain a constant flow of abrasive to the cutting nozzle.

One example is found in U.S. Pat. No. 4,478,368 which teaches the transport of abrasive to a waterjet nozzle from a pressurized container. The flow from the pressurized abrasive container is controlled by a control valve and a pressure regulator with the line pressure being measured by a pressure meter.

Another example is found in U.S. Pat. No. 5,320,289 which teaches the transport of abrasive material to a waterjet using a vacuum assist line under the control of a controller to meter the flow of abrasive from a hopper.

Yet another example is seen in U.S. Pat. No. 5,854,744 which teaches the transport of abrasive to a waterjet using a vibrating hopper controlled by a controller.

None of these prior art systems assure the constant flow of abrasive under varying external pressure conditions found at the opening of the discharge tank or at the hopper or other container for the abrasive. Thus a system was needed for discharging abrasive to the cutting nozzle which was independent of these external pressure variations.

SUMMARY OF THE INVENTION

The present invention solves the problems associated with prior art abrasive delivery systems to the cutting nozzle and others, by providing an improved abrasive delivery system (10) for delivering an abrasive material (14) to a cutting nozzle (not shown) which will have no external pressure effects varying the abrasive delivery.

To accomplish this, the system (10) of the present invention uses a pressurized container or hopper (12) and a delivery hose (18) to transport the abrasive material (14) to the nozzle. Pressure regulated air is delivered to the hose inlet and the hopper at a pressure adequate to push the suspended abrasive through the required length of hose. The classical flow orifice is used to regulate the flow of abrasive as it exits the hopper. Since the pressure is maintained equal above and below the orifice, it does not influence the abrasive flow through it.

As the process requires greater abrasive flow, the flow orifice is changed to a larger diameter and pressure is increased as necessary to move the abrasive. The advantage of this system is the metering device is located at the hopper and is not a separate unit.

In view of the foregoing it will be seen that one aspect of the present disclosure is to provide an abrasive delivery system to waterjet cutting nozzles having a constant abrasive flow for differing external pressures.

Another aspect of the present invention is to provide an abrasive delivery system to waterjet cutting nozzles having no pressure difference between the abrasive holding tank and the abrasive delivery orifice.

Yet another aspect of the present invention is to provide an abrasive delivery system to waterjet cutting nozzles having a abrasive container and metering nozzle in close proximity to one another even if the cutting nozzle is connected at a distance therefrom.

These and other aspects of the present invention will be more fully understood upon a review of the following description of the preferred embodiment when considered in conjunction with the accompanying drawings.

BRIEF DESCRIPTION OF THE DRAWINGS

In the drawings:

FIG. 1 is a schematic view of the abrasive delivery system of the present invention.

DESCRIPTION OF THE PREFERRED EMBODIMENT

Referring now to the drawing where the embodiments are intended to describe a preferred embodiment of the invention and not limit it to same, FIG. 1 shows an abrasive material delivery system (10) having a sealed container (12) which holds the abrasive material (14) and is pressurized as required. The abrasive material, such as garnet cutting fines, is supplied to the container (12) through a top located fill hole (16) which is plugged during operation. The abrasive material is supplied to an abrasive cutting nozzle (not shown) by way of a hose (18) connected to the nozzle. An on/off valve (20) controllably starts or stops the flow of abrasive material from the container (12) to the hose (18) in response to a control signal from the nozzle operator. An abrasive flow orifice (22) is mounted in line with hose (18) downstream of the on/off switch (20) and regulates the flow of abrasive material in the hose (18) by the size of the orifice (22) and the pressure subjected across the orifice (22).

The system (10) includes an air pressure regulator (24) controlled by the nozzle operator by which the operator may set the required pressure in the container (12) to push the abrasive material through the hose (18) to the nozzle. This is done by applying compressed air to the regulator (24) through line (26) from a source of air pressure (not shown) The regulator (24) sets the air pressure to the operator desired level and passes it to the container (12) by way of connecting line (28) leading from the regulator outlet to the container. The same regulated air pressure from line 28 is also connected by line (30) to the hose (18) entering it just downstream of the orifice (22) so as to be in close proximity to both the orifice (22) and the container (12). The abrasive delivery hose (18) is of significant length in the range of 20 to 100 feet or greater and thus transport the abrasive material while in suspension to the cutting nozzle at a constant volume flow since the orifice is subjected to the same pressure on both sides thereof and is thus dependant only on the pressure difference produced by a line drop in pressure when the cutting nozzle is activated. However, it will be understood that the pressure drop is beyond the area proximate to the orifice (22) and the pressure across it remains the same on both sides. Air pressure gauges (32) and (34) may be used (not required) to verify the same pressure is being supplied across the orifice (22).

It will be understood that certain obvious additions and modifications have been deleted herein for the sake of conciseness and readability but they properly fall within the scope of the following claims. By way of example, the gauges (32, 34) may be connected to a logic device which sends out a control signal allowing the actuation of the cutting nozzle only when both gauges are at the same pressure.

What is claimed is:

1. A constant volume abrasive particulate material delivery system for supplying a constant volume of abrasive particulate material to a waterjet cutting nozzle independent of supply line lenght comprising;

a pressurized container for holding abrasive particulate material therein for use by the waterjet cutting nozzle;

a long supply hose having a length varying between 20 feet and 100 feet connected to said pressurized container and the cutting nozzle, a metering orifice located in said supply hose proximate to said pressurized container for metering the flow of abrasive material there through;

an on/off valve located in said supply hose upstream of said orifice and proximate to said pressurized container to control the flow of abrasive material from said pressurized container to said metering orifice in response to a signal from the waterjet cutting nozzle operator; and an air pressure supply system having a first line connected to said container to pressurize said container to a preset pressure and a second line connected to said supply hose proximate to said metering orifice to provide the same preset pressure across said metering orifice to allow a constant volume flow of abrasive material to said supply hose due to the same preset pressure being applied across said metering orifice even while the flow of abrasive particles is controlled by the pressure drop in the remaining length of said supply hose leading to the cutting nozzle.

* * * * *